United States Patent [19]

McCullough

[11] 4,082,484

[45] Apr. 4, 1978

[54] SCROLL-TYPE APPARATUS WITH FIXED THROW CRANK DRIVE MECHANISM

[75] Inventor: John E. McCullough, Carlisle, Mass.

[73] Assignee: Arthur D. Little, Inc., Cambridge, Mass.

[21] Appl. No.: 761,889

[22] Filed: Jan. 24, 1977

[51] Int. Cl.[2] ..... F04C 17/02; F04C 29/10

[52] U.S. Cl. ..... 418/55; 418/57; 418/109

[58] Field of Search ..... 418/55, 57, 107, 108, 418/109

[56] References Cited

U.S. PATENT DOCUMENTS

| | | | |
|---|---|---|---|
| 1,223,997 | 4/1917 | May | 418/57 |
| 2,243,874 | 6/1941 | Lysholm | 418/201 |
| 2,822,124 | 2/1958 | Klessig et al. | 418/108 |
| 3,348,529 | 10/1967 | Assum | 418/57 |
| 3,994,633 | 11/1976 | Shaffer | 418/55 X |

*Primary Examiner*—Carlton R. Croyle
*Assistant Examiner*—Leonard E. Smith
*Attorney, Agent, or Firm*—Bessie A. Lepper

[57] ABSTRACT

A positive fluid displacement scroll apparatus (compressor or expander) wherein the scroll members run with a small clearance between the wrap side flanks, thus essentially eliminating wearing of the wraps. When efficient radial sealing is attained, very little overall efficiency is sacrificed for the ability to construct low-cost scroll apparatus for a number of uses.

19 Claims, 10 Drawing Figures

SCROLL-TYPE APPARATUS WITH FIXED THROW CRANK DRIVE MECHANISM

This invention relates to scroll-type apparatus and more particularly to scroll-type compressors and expanders operating at relatively high speeds and moderate pressures for uses wherein some small degree of efficiency can be sacrificed for low cost and long operational life.

There is known in the art a class of devices generally referred to as "scroll" pumps, compressors and engines wherein two interfitting spiroidal or involute spiral elements of like pitch are mounted on separate end plates. These spiral elements are angularly and radially offset to contact one another along at least one pair of line contacts such as between spiral curved surfaces. A pair of line contacts will lie approximately upon one radius drawn outwardly from the central region of the scrolls. The fluid volume so formed therefore extends all the way around the central region of the scrolls. In certain special cases the pocket or fluid volume will not extend the full 360° but because of special porting arrangements will subtend a smaller angle about the central region of the scrolls. The pockets define fluid volumes, the angular position of which varies with relative orbiting of the spiral centers; and all pockets maintain the same relative angular position. As the contact lines shift along the scroll surfaces, the pockets thus formed experience a change in volume. The resulting zones of lowest and highest pressures are connected to fluid ports.

An early patent to Creux (U.S. Pat. No. 801,182) describes this general type of device. Among subsequent patents which have disclosed scroll compressors and pumps are U.S. Pat. Nos. 1,376,291, 2,475,247, 2,494,100, 2,809,779, 2,841,089, 3,560,119, 3,600,114, 3,802,809 and 3,817,664 and British Pat. No. 486,192.

Although the concept of a scroll-type apparatus has been known for some time and has been recognized as having some distinct advantages, the scroll-type apparatus of the prior art, as represented, for example, in the above-cited patents, has not been commercially successful, primarily because of sealing and wearing problems which have placed severe limitations on the efficiencies, operating life, and pressure ratios attainable. Such sealing and wearing problems are of both radial and tangential types. Thus effective axial contacting must be realized between the ends of the involute spiral elements and the end plate surfaces of the scroll members which they contact to seal against radial leakage and achieve effective radial sealing; and for highly effecient machines effective radial contacting with minimum wear must be attained along the moving line contacts made between the involute spiral elements to seal against tangential leakage.

Recently, however, the problems associated with sealing and wear have been minimized to the extent that scroll-type apparatus are able to compete in efficiency with other types of compressors, expansion engines and pumps. Solutions to these problems are embodied in the novel apparatus described in U.S. Pat. Nos. 3,874,827, 3,884,599, 3,924,977, 3,994,633 and 3,994,636, all of which are assigned to the same assignee as this present invention. These solutions include providing means to counteract at least a portion of the centrifugal forces acting on the orbiting scroll member and to control tangential sealing forces along line contacts between the involute wraps of the scroll members; providing axial compliance/sealing means to insure efficient radial sealing between the involute wrap ends and the surfaces of the scroll member end plates; and providing novel means for developing axial forces to continually urge the scroll members into contact to maintain radial sealing.

As a result of the provision of these solutions to the basic scroll-type apparatus construction problems, there has now developed a demand for scroll-type apparatus of a wide range of capabilities to meet a growing demand for compressors and expanders in a number of different applications. Among such types of scroll apparatus are relatively high-speed (e.g., greater than about 1800 rpm) compressors and expanders operating at moderate pressures (e.g., no greater than about 100 psi) for use in the home, on the farm, in light industry and the like. Compressors and expanders of this general character generally must be low in cost, relatively small in size (e.g., up to about three BHP) and capable of being used intermittently over long periods of time without maintenance. Typically in such applications, a trade-off of some small degree of operational efficiency for the attainment of these characteristics is acceptable, if not desirable.

It is therefore a primary object of this invention to provide scroll-type apparatus which is particularly suitable for high-speed, moderate-pressure operation. It is another object to provide scroll-type apparatus of the character described which is relatively low in cost to manufacture and capable of being run intermittently over long periods of time without maintenance. Yet another object of this invention is to provide compressors particularly suitable for use in the home, on the farm, in small industries and the like. A further object is to provide scroll-type apparatus, both compressors and expanders, of a novel design which essentially eliminates any wear between the wraps of the scroll members and realizes an acceptable level of efficiency.

Other objects of the invention will in part be obvious and will in part be apparent hereinafter.

According to one aspect of this invention, there is provided a positive fluid displacement apparatus into which fluid is introduced through an inlet port for circulation through the apparatus and subsequently withdrawn through a discharge port, which comprises a stationary scroll member having an end plate and an involute wrap and an orbiting scroll member having an end plate and an involute wrap, driving means for orbiting the orbiting scroll member with respect to the stationary scroll member whereby the side flanks along with the end plates of the involute wraps define at least one moving pocket of variable volume and zones of different fluid pressure, coupling means to maintain the scroll members in fixed angular relationship, axial force-applying means for providing an axial force to urge the involute wrap of the stationary scroll member into axial contact with the end plate of the orbiting scroll member and the involute wrap of the orbiting scroll member into axial contact with the end plate of the stationary scroll member thereby to achieve radial sealing of said pockets, and being characterized in that the driving means are arranged to effect the orbiting of the orbiting scroll member such that a small clearance is maintained between the side flanks of the wraps, thereby to essentially eliminate wear of the side flanks over extended periods of operation while retaining the essential integrity of the zones of different fluid pressure.

In a preferred embodiment of the apparatus of this invention, the driving means comprise a drive shaft terminating in a crank plate and rotatable on the machine axis; a stub shaft extending from the orbiting scroll member on an axis parallel with and spaced from the machine axis by a distance equivalent to the orbit radius of the orbiting scroll member; a bearing mount; counterweight; and locking means to rigidly affix the bearing mount and counterweight means to the crank plate in a predetermined relation thereby to define the clearance.

In yet a further preferred embodiment of this apparatus the locking means is adjustable to provide for adjustment of the clearance between the wrap flanks. Typically this clearance ranges between about 0.002 and 0.010 inch.

For a fuller understanding of the nature and objects of the invention, reference should be had to the following detailed description taken in connection with the accompanying drawings in which FIG. 1 is a longitudinal cross section of a scroll-type compressor constructed in accordance with this invention;

Figure 1:
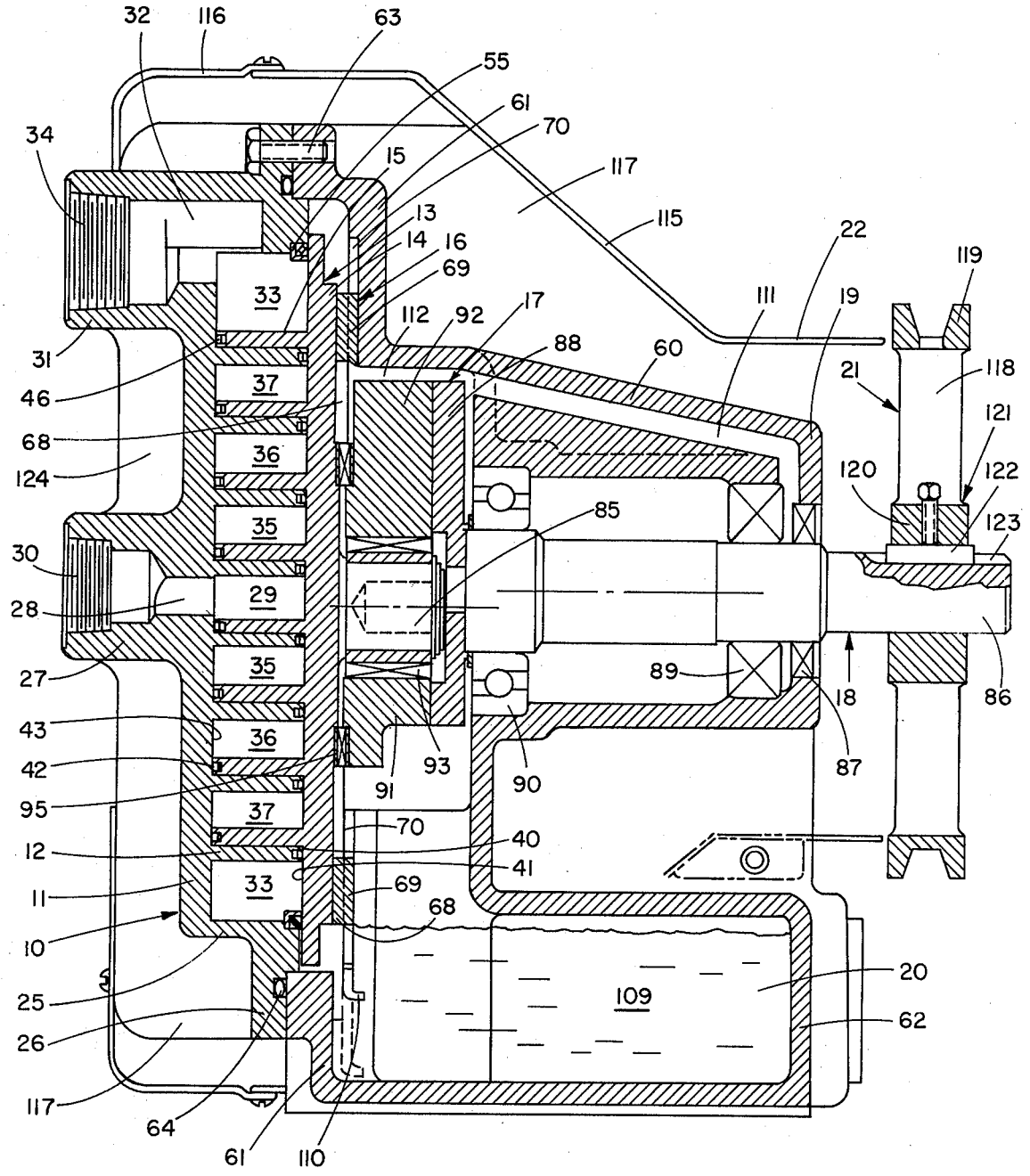

The principles of the operation of scroll apparatus have been presented in previously issued patents. (See for example U.S. Pat. No. 3,884,599.) It is therefore unnecessary to repeat a detailed description of the operation of such apparatus. It is only necessary to point out that a scroll-type apparatus operates by moving a pocket of fluid taken from one region into another region which may be at a different pressure. If the fluid is compressed while being moved from a lower to higher pressure region, the apparatus serves as a compressor; if the fluid is expanded while being moved from a higher to lower pressure region it serves as an expander; and if the fluid volume remains essentially constant, then the apparatus serves as a liquid pump or motor.

The pocket of fluid is bounded by two parallel planes defined by end plates, and by two nearly cylindrical surfaces defined by the involute of a circle or other suitably curved configuration. The scroll members have parallel axes since in only this way can the continuous sealing contact between the plane surface of the scroll members be maintained.

Throughout the following description the term "scroll member" will be used to designate the component which is comprised of both the end plate and the elements which define the contacting surfaces making movable line contacts. The term "wrap" will be used to designate these elements making moving line contacts. These wraps have a configuration, e.g., an involute of a circle (involute spiral), arc of a circle, etc., and they have both height and thickness as well as flank sides. The term "radial sealing" is used to designate the sealing between wrap ends and the end plates they contact, i.e., it refers to that aspect of sealing which prevents the leakage of working fluid radially outward across the wrap ends. The term "tangential sealing" is used to designate the sealing along the moving line contacts made by the scroll wraps in prior art devices as the orbiting scroll member is driven to orbit the stationary scroll member.

Heretofore in designing scroll-type apparatus it has always been considered necessary to attain effective sealing of the moving fluid pockets, both radially and tangentially, in order to have a compressor expander with acceptable efficiency. In the earlier embodiments of this class of machinery the solutions proposed to the problems of radial and tangential sealing in scroll apparatus were, at best, only partially satisfactory, for they invariably involved or induced serious wear problems with use. Thus such sealing and wearing problems placed severe limitations on the efficiencies, operating life and pressure ratios attainable in early scroll-type apparatus.

Recent developments in scroll apparatus have, however, provided both radial and tangential sealing means which achieve effective sealing with minimum wear. These radial sealing means are described in U.S. Pat. Nos. 3,994,633 and 3,994,636, the latter of which discloses unique axial compliance/sealing means which comprise seal elements generally shaped to have the same configuration as the wrap members with which they are used and means to actuate the seal elements by urging them into contact, with a predetermined preload, with the opposing scroll member end plate. The means to actuate the seal element to make axial sealing contact may be pneumatic, mechanical or a combination of pneumatic and machanical. These axial compliance/sealing means are preferably used in conjunction with means which provide some axial forces to urge the surfaces of the wrap and end plates into contact, such as the pneumatic loading means described in U.S. Pat. No. 3,994,633 or the hydrodynamic thrust bearing means described in U.S. application Ser. No. 722,695 filed Sept. 13, 1976, in the name of John E. McCullough and assigned to the same assignee as the present invention.

Improved tangential sealing has come with the use of an orbiting scroll member driving means which provides a centripetal radial force adapted to oppose at least a fraction of the centrifugal force acting on the orbiting scroll member (see U.S. Pat. No. 3,884,599); and more particularly the use of a driving means which is linked to the orbiting scroll member through a radially compliant mechanical linking means such as a swing link or sliding-block link (see U.S. Pat. No. 3,924,977). The use of these driving means in conjunction with the above-described axial compliance/sealing means makes it possible to use wraps which need not be machined to such close tolerances as would be required if the orbit radius for the orbiting scroll member is fixed.

It has now been found, contrary to previous teaching, that for some uses of scroll machinery actual line contacts are not necessary between the wrap flanks as the orbiting scroll member is driven to orbit the stationary scroll member. Thus, for example, in some applications for relatively high-speed, moderate-pressure compressors and expanders operating on a gas containing no substantial amount of liquid and where some tradeoff between overall efficiency and cost are possible, the scroll members may be assembled so that they define a small clearance between the wrap flanks. The clearance may be deliberately built in when the compressor or expander is assembled, or it may be the result of the wearing-in of relatively soft surfaces applied to the wrap flanks. A preferred driving means incorporates an adjustable fixed-thrown crank.

FIG. 1 illustrates, in longitudinal cross section, a scroll compressor constructed in accordance with the invention. For convenience in the following detailed description, the apparatus used to illustrate this invention will be referred to as a compressor. However, it is equally suitable as an expander. The compressor, as shown in FIG. 1, is comprised of a stationary scroll member 10 formed of an end plate 11 and involute wraps 12; an orbiting scroll member 13 formed of an end plate 14 and involute wraps 15 (see also FIG. 3); a coupling member 16, a drive mechanism generally indicated by reference numeral 17; crank and shaft assembly means generally indicated by reference numeral 18; housing 19 including an oil sump 20, cooling fan 21 and cover 22.

End plate 11 of the stationary scroll member terminates in a peripheral ring 25 and an outwardly extending flange 26, these portions of end plate 11 forming a part of the apparatus housing. End plate 11 also has a central stub extension 27 defining a high-pressure fluid passage 28 in communication with high-pressure fluid pocket 29 defined by wraps 12 and 15. This central stub extension 27 is internally threaded at 30 for engagement with a high-pressure fluid conduit (not shown). End plate 11 also has a peripherally positioned stub extension 31 defining a low-pressure fluid passage 32 communicating with the low-pressure peripheral fluid pocket 33 and being threaded at 34 for engagement with a low-pressure fluid conduit (not shown).

Figure 2:
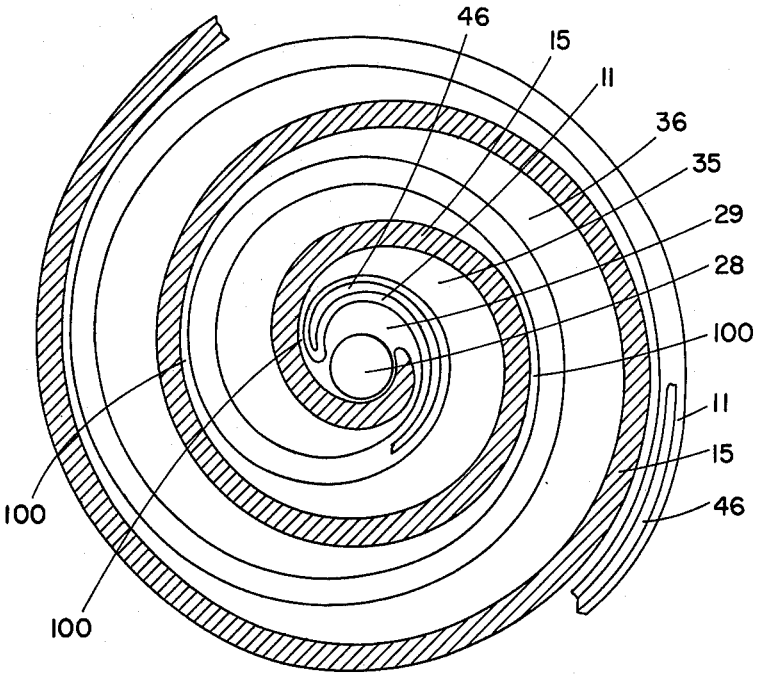
FIG. 2 is a partial cross sectional view of the scroll member wraps of FIG. 1 showing the clearance between the wrap flanks.
Figure 4:
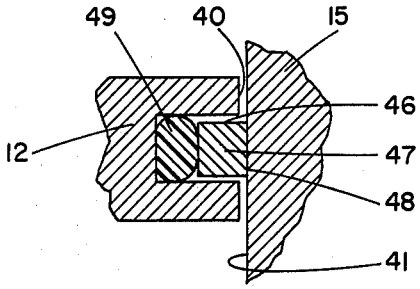
FIG. 4 is an enlarged detailed cross section of the radial sealing means used to seal the scroll member wraps to the end plates.

Radial sealing of the fluid pockets 29, 33 and intermediate-pressure pockets 35, 36 and 37 must be achieved across end surfaces 40 of stationary scroll member wraps 12 and the inner surface 41 of orbiting scroll end plate 14 and across end surfaces 42 of orbiting scroll member wraps 15 and the inner surface 43 of stationary scroll end plate 11. This is preferably accomplished through the use of axial compliance/sealing means illustrated in detail in FIG. 4 for the stationary scroll member wrap and the orbiting scroll member end plate. The involute wrap 12 of the stationary scroll member has a channel 46 (see also FIG. 2) cut along essentially its entire length following the same involute configuration as the wrap. A seal element 47, formed of either a metallic or nonmetallic material, is sized to fit in channel 46 to experience small excursions in both the axial and radial directions. The surface 48 of seal element 47 is urged into sealing contact with surface 41 of the orbiting scroll member end plate 15 by a force-applying means, illustrated in FIG. 4 as an elastomeric o-ring cord 49. In like manner, a seal element and actuating means are placed in a channel in the end of the wrap of the orbiting scroll member as shown somewhat schematically in FIG. 1. As will be described below, means are also provided to urge the wraps and end plates into sealing contact.

Figure 5:
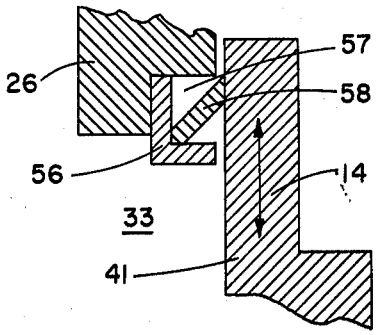
FIG. 5 is an enlarged detailed cross section of the oil seal ring between the orbiting scroll member and the peripheral housing extension of the stationary scroll member.

The diameter of end plate 14 of the orbiting scroll member is sufficiently great such that it always extends beyond the inner edge of flange 26, thus permitting the placement of an oil seal ring 55 between end plate 14 and flange 26 to seal off the fluid pockets from the remainder of the apparatus. This in turn allows the drive mechanism and bearings to be oil-lubricated while maintaining the working fluid substantially free from any liquid. The oil seal ring 55 is shown in enlarged detail in FIG. 5 and it is seen to be formed of a right-angled ring 56, set in an inner peripheral groove 57 cut in flange 26, and a frustoconical scraper ring 58 configured to set in the angle of ring 56 and to make rubbing contact with surface 41 of end plate 14. This oil seal ring effectively prevents the passage of any lubricating oil in the volume surrounding the orbiting scroll member from entering the moving fluid pockets.

The housing, generally indicated by the reference numeral 19, is comprised of ring extension 25 of the stationary scroll member, flange 26, main housing section 60 which is flanged at 61 and is integral with a lower oil sump housing 62. The housing is attached and sealed to the scroll members through flanges 26 and 61 by a plurality of bolts 63 using an o-ring seal 64.

Figure 3:
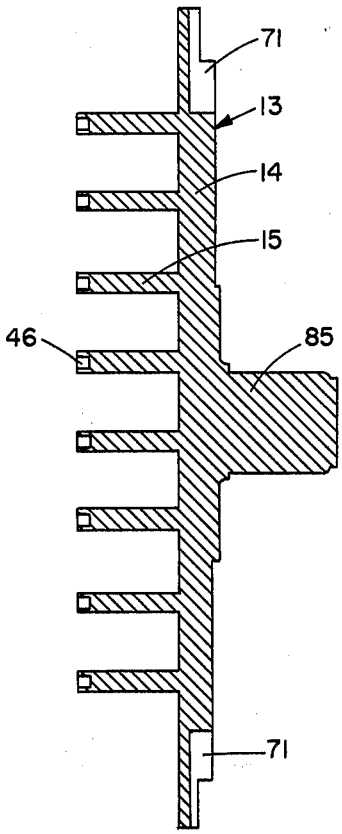
FIG. 3 is a cross sectional view of the orbiting scroll member rotated 90° from its position shown in FIG. 1.

In operation, the two scroll members must be maintained in a fixed angular relationship, and this is done through the use of coupling member 16. The coupling member illustrated in the apparatus embodiment of FIG. 1 is essentially the same as the coupling member described in U.S. Pat. No. 3,994,633 (see FIG. 14 of that patent and the detailed description thereof). Thus as seen in FIG. 1, the coupling member comprises a ring 68 having oppositely disposed keys 69 on one side thereof slidingly engaging keyways 70 in the inner surface of housing flange 61. A second pair of keys (not shown) are oppositely disposed on the other side of coupling ring 68 to slidingly engage keyways 71 in the end plate of the orbiting scroll member (FIG. 3).

Figure 9:
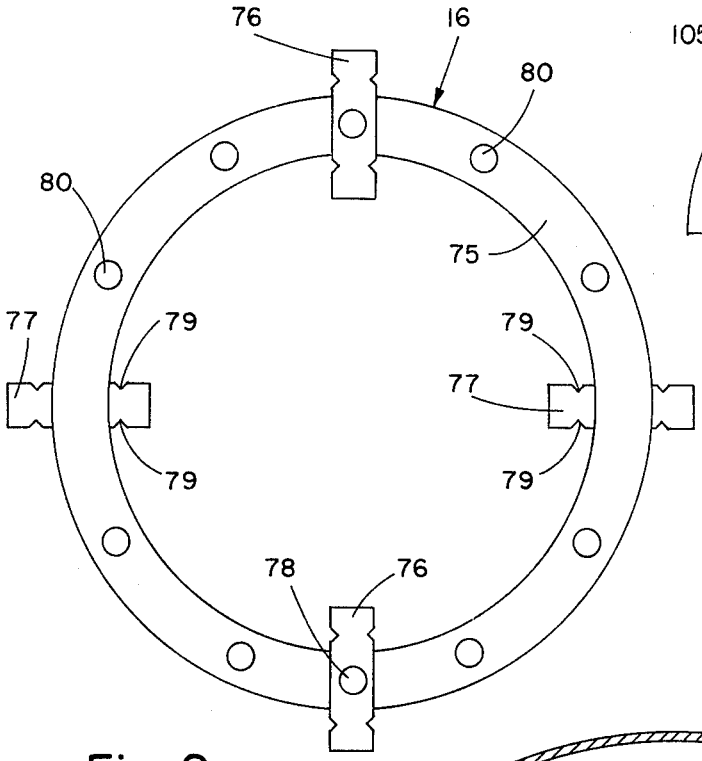
FIG. 9 is an end view of a preferred form of coupling member.

Another preferred embodiment of the coupling member is described and claimed in copending application Ser. No. 722,713, filed Sept. 13, 1976, in the name of John E. McCullough and assigned to the same assignee. This embodiment of the coupling member is shown in top plan view in FIG. 9. For a detailed description of the construction of this coupling member, reference should be had to the disclosure in Ser. No. 722,713. The coupling member of FIG. 9 comprises a coupling ring 75, which may be formed of a relatively light weight alloy, with a first pair of two key blocks 76 to engage keyways 70 in the housing flange 61 and a second pair of key blocks 77 to engage keyways 71 in the orbiting scroll member. Key blocks 76 are displaced 90° from key blocks 77 and on the opposite side of ring 75. Each of the key blocks is formed of a self-lubricating material such as a polyimide or a polytetrafluoroethylene, and each is affixed to ring 75 through a pivot pin 78. Each key block has two parallel spaced oil grooves 79 cut in its two larger lateral faces. Both sides of ring 75 have a plurality of spaced axial force-stabilizing disks 80 formed of a self-lubricating material set in counterbores in the ring surfaces. This embodiment of coupling member is particularly suited for extended periods of use without maintenance. Inasmuch as the stationary scroll member 10 is rigidly affixed, through bolts 63, to the housing, keying the coupling member to the housing effectively serves to couple the stationary and orbiting scroll members.

Orbiting scroll member 13 has a stub shaft 85 (see also FIG. 3) affixed to or integral with end plate 14. The orbiting scroll is driven by a motor (not shown) external of the housing and engageable with compressor shaft 86 extending into the housing through an oil seal 87 and terminating in a crank plate 88 which may be affixed to or integral with shaft 86. Shaft 86 is mounted in the housing through shaft bearing 89 and crank bearing 90.

Figure 6:
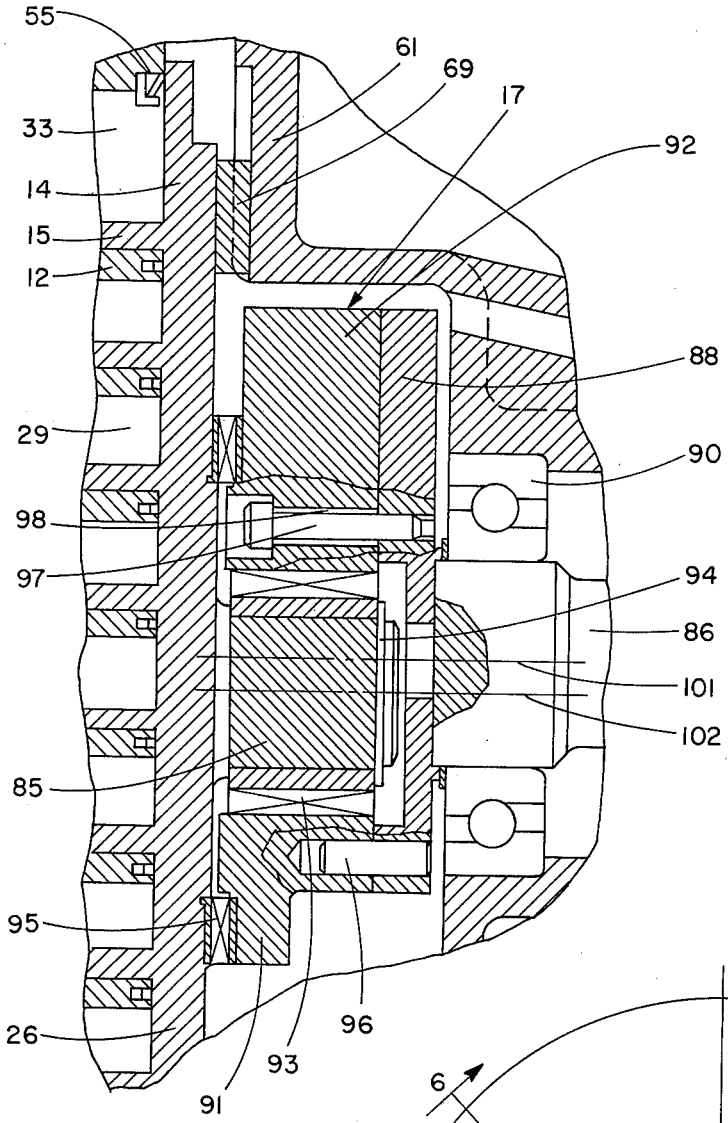
FIG. 6 is a detailed longitudinal cross sectional view through a preferred embodiment of the orbiting scroll member driving means of this invention showing the adjustable fixed-throw crank.
Figure 7:
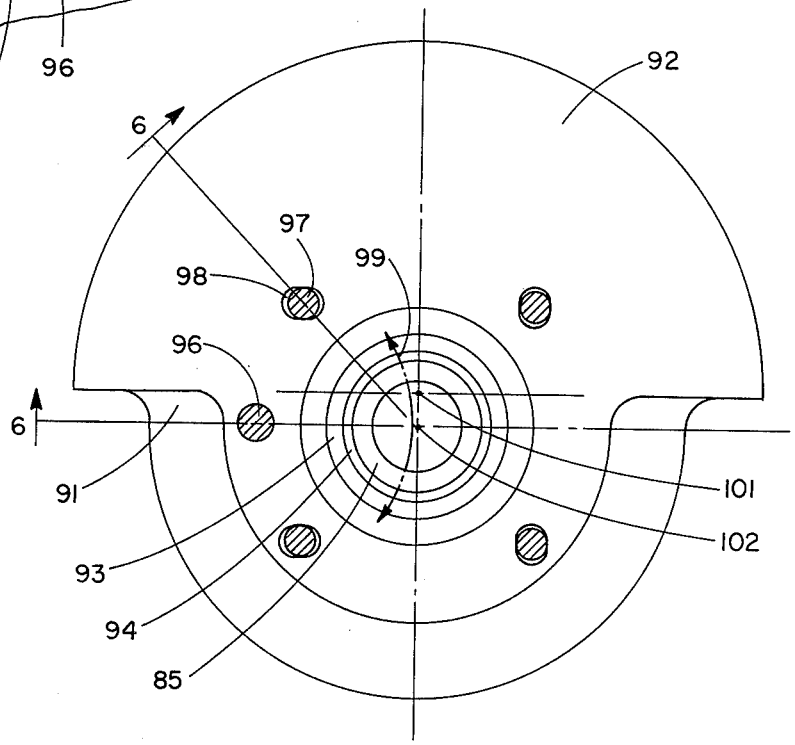
FIG. 7 is a cross sectional view of the driving means of FIG. 6.

The drive mechanism of the scroll apparatus is shown in enlarged detail in FIG. 6. The orbiting scroll member is affixed to drive shaft 86 through bearing mount 91, configured as shown in FIG. 7, to have a counterweight 92 for the purpose of balancing the centrifugal force of the orbiting scroll member. Bearing mount 91 engages the stub shaft 85 through needle bearing 93 held in place by snap ring 94. Interposed between bearing mount 91 and the outer surface of the end plate of orbiting scroll member 13 is a thrust face bearing 95 which acts as the axial force-applying means to urge the end plates and wrap ends of the two scroll members together to realize the desired axial sealing through the axial compliance/-sealing means described above. Thrust face bearing 95 carries the load from orbiting scroll member 13 through the crank bearing 90 and subsequently to the housing.

Main shaft 86, crank plate 88, bearing mount 91 and counterweight 92 make up the adjustable fixed-throw drive mechanism of the scroll machinery of this invention shown in enlarged detail in FIGS. 6 and 7. It will be appreciated that FIG. 6 actually represents a cross section through the wedge-shaped plane 6—6 of FIG. 7, the purpose being to more clearly show the construction of the adjustable fixed-throw drive mechanism.

In affixing the orbiting scroll member to crank plate 88, provision is made to adjust the position of the wrap of the orbiting scroll member relative to the wrap of the stationary scroll member. This is accomplished by adjusting the position of the bearing mount 91/counterweight 92 assembly relative to crank plate 88 through the use of pivot pin 96 and locking screws 97 (preferably four) which extend through slots 98 in the bearing mount 91/counterweight 92 assembly into threading in crank plate 88. As will be seen from FIG. 7, slots 98 are so configured as to permit the bearing mount 91/counterweight 92 assembly to be moved through a small arc, indicated by arrow 99, prior to locking this assembly to crank plate 88 by means of screws 97. It has been found, in accordance with this invention, that if efficient radial sealing is attained such as through the use of the compliance/sealing means described, it is possible to adjust this fixed-throw crank drive mechanism such that there exists a small clearance 100 (FIG. 2) between the wraps of the scroll members where normally they would form moving line contacts. This in turn means that there occurs substantially no wearing of the wrap flanks during operation. It also means that no special machining of the wraps need be performed in manufacturing the scroll members. In operation, it is preferred that the clearance 100 between the flanks of the scroll member wraps be kept between about 0.002 and 0.010 inch.

The clearance between the wraps may be established in one of several ways. In assembling the apparatus, a thin shim of metal of a thickness equivalent to the clearance may be inserted between the wraps and then subsequently removed when locking screws 97 are tightened. Alternatively, the orbit radius of the scroll members is measured during a trial assembly and the orbit radius of the drive crank assembly set at this value minus the desired flank clearance.

For any given compressor or expander design and size, it will generally be convenient to operate the apparatus to determine what orbit radius is desired (equivalent to the distance between the machine axis 101 and orbiting scroll member axis 102 (FIG. 7); and then set bearing mount 91 at an orbit radius slightly less than that at which wrap-to-wrap line contacts occur.

The actual magnitude of the clearance finally left between the wraps is normally dependent, at least to some extent, on the size of the compressor or expander. In general, the larger the machine, the larger may be the clearance. The magnitude of the clearance may also be dependent upon the pressures within the fluid pockets, being permissibly greater for lesser pressures.

The adjustable embodiment of the fixed-throw crank illustrated in FIGS. 6 and 7 permits adjustment of the clearance both at the time of manufacture and, if desired, later after operating the compressor.

Figure 8:
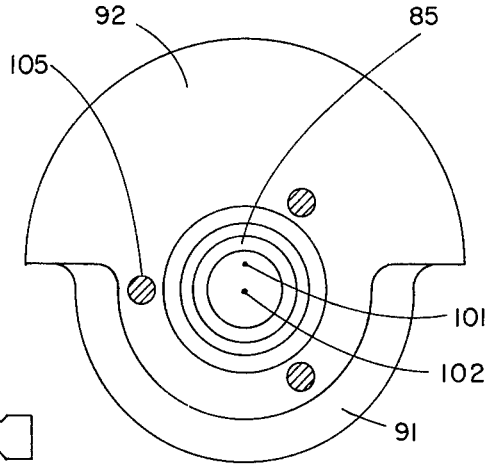
FIG. 8 is a cross sectional view of a fixed throw driving means which is not adjustable.

Although the adjustable fixed-throw crank illustrated in FIGS. 6 and 7 represents the preferred embodiment of this invention, it is within the scope of the invention to use a fixed-throw crank which is not adjustable, that is one which is designed and constructed to have the bearing mount 91/counterweight 92 assembly initially and permanently affixed to crank plate 88 such that the desired clearance between the wraps of the orbiting and stationary scroll members is defined. As shown in FIG. 8, in this embodiment, the bearing mount 91/counterweight 92 assembly may be affixed to crank plate 88 through two or more screws 105.

One convenient way to assemble the scroll members when the fixed throw crank is not adjustable is to permit the clearance to wear in by coating the wrap flanks with a readily wear-removable material such as polytetrafluoroethylene, the coating being a thickness essentially equivalent to the desired clearance. The apparatus is then assembled so that line contacts are just made between the wrap flanks. Then through a short period of operation the coating is worn away leaving the desired clearance and preventing the wearing of the wrap material itself.

As noted above with regard to the general description of the apparatus illustrated in FIG. 1, there is provided an oil sump 20 in lower section 62 of the apparatus housing. The lubricating oil 109 from sump 20 is delivered to coupling member 16 and to the various shaft and drive bearings within housing 19 by means of one or more oil fingers 110 affixed to the coupling member. These oil fingers are of a length such that they are periodically dipped into oil 109 and then raised to fling the oil upward within the housing for circulation and return into the oil sump. An oil passage 111 is provided to conduct some of the oil flung directly into housing cavity 112, which surrounds the crank plate and bearing mount, to shaft bearing 89.

Figure 10:
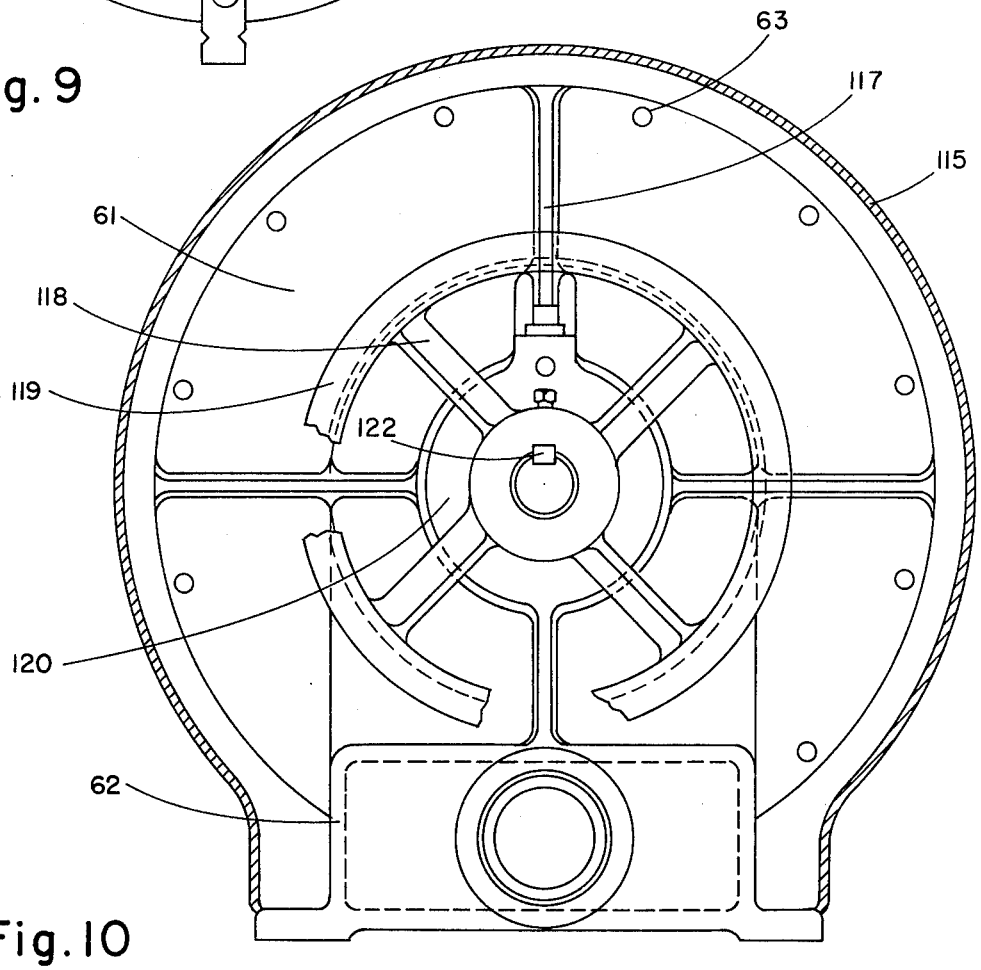
FIG. 10 is an end view of the compressor of FIG. 1.

In the apparatus embodiment of FIG. 1 means are provided to air cool the compressor housing, and through the housing to air cool the elements of the compressor and the circulating lubricating oil. These means are also illustrated in end view in FIG. 10, and reference should be had to both FIGS. 1 and 10 in the following description.

An air duct 115, terminating in a duct cover 116, is mounted around the apparatus housing and supported on the drive end of a plurality of housing fin members 117. Cooling air is circulated through the air duct 115 by means of fan 21 which comprises a plurality of fan blades 118 mounted between the outer, belt-engaging rim 119 and the inner shaft engaging ring 120 of a pulley 121. Pulley 121 is affixed to main shaft 86 through a key 122 engagable with keyway 123 in shaft 86. Duct cover 116 is affixed to the scroll member end of the housing fin members 117, and it terminates short of covering the scroll member end in order to leave a series of air discharge openings 124 so that air drawn in by fan 21 is circulated over the apparatus housing from drive end to scroll member end and discharged through openings 124.

By achieving efficient radial sealing between the wrap ends and the end plates of the scroll members, using for example the axial compliance/sealing means described, it is possible to construct scroll apparatus having small clearance between the flanks of the wraps without sacrificing an undue degree of overall efficiency. Thus, for example, in a compressor constructed in accordance with this invention requiring a power input of 3 hp, a maximum pressure of 100 psi, operating at 3450 rpm and having wrap clearances of 0.005 inch, it is possible to achieve an efficiency which is well within 5% of the efficiency of a comparable machine wherein actual moving line contact is maintained between the wraps of the stationary and orbiting scroll members. The ability to operate with this clearance materially reduces machining costs in constructing the scroll members and virtually eliminates wearing of the flanks of the wraps. Thus it is possible to economically construct scroll compressors or expanders which have long operational lives.

It will thus be seeen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

I claim:

1. In a positive fluid displacement apparatus into which fluid is introduced through an inlet port for circulation through said apparatus and subsequently withdrawn through a discharge port, and comprising a stationary scroll member having an end plate and an involute wrap and an orbiting scroll member having an end plate and an involute wrap, driving means for orbiting said orbiting scroll member with respect to said stationary scroll member whereby the side flanks along with said end plates of said involute wraps define at least-one moving pocket of variable volume and zones of different fluid pressure, coupling means to maintain said scroll members in fixed angular relationship, axial force-applying means for providing an axial force to urge said involute wrap of said stationary scroll member into axial contact with said end plate of said orbiting scroll member and said involute wrap of said orbiting scroll member into axial contact with said end plate of said stationary scroll member thereby to achieve radial sealing of said pockets, characterized in that said driving means are arranged to effect the orbiting of said orbiting scroll member such that a small clearance is maintained between said side flanks of said wrap thereby to essentially eliminate wear of said side flanks over extended periods of operation while retaining the essential integrity of said zones of different fluid pressure.

2. A positive fluid displacement apparatus in accordance with claim 1 wherein said driving means are arranged to maintain said clearance no greater than about 0.010 inch.

3. A positive fluid displacement apparatus in accordance with claim 1 wherein said driving means comprise means to adjust said clearance.

4. A positive fluid displacement apparatus in accordance with claim 1 wherein said driving means comprise, in combination (a) a drive shaft terminating in a crank plate and rotatable on a machine axis;

(b) a stub shaft extending from said orbiting scroll member, having bearing mount and counterweight means rigidly affixed thereto and rotatable on an axis parallel with and spaced from said machine axis by a distance equivalent to the orbit radius of said orbiting scroll member; and (c) locking means to rigidly affix said bearing mount and counterweight means to said crank plate in a predetermined relation thereby to define said clearance.

5. A positive fluid displacement apparatus in accordance with claim 4 wherein said locking means is adjustable.

6. A positive fluid displacement apparatus in accordance with claim 5 wherein said locking means comprises a pivot pin hole and a plurality of spaced threaded openings in said crank plate, a pivot pin hole in alignment with said pivot pin hole in said crank plate and a plurality of slots in said bearing mount and counterweight means in alignment with said threaded openings in said crank plate, a pivot pin seated in said pivot holes and threaded locking screws extending through said slots in said bearing mount and counterweight means and engaging threaded openings in said crank plate, whereby said bearing mount and counterweight means may be moved through a small arc relative to said crank plate to adjust said clearance prior to rigidly locking said stub shaft to said drive shaft.

7. A positive fluid displacement apparatus, comprising in combination (a) a stationary scroll member having an end plate and an involute wrap;

(b) an orbiting scroll member having an end plate and an involute wrap;

(c) driving means, incorporating a main shaft and an orbiting scroll member shaft parallel therewith, for orbiting said orbiting scroll member whereby the side flanks along with said end plates of said involute wraps define moving pockets of variable volume and zones of different fluid pressure, said driving means being arranged to effect the orbiting of said orbiting scroll member such that a small clearance is maintained between said side flanks of said wraps thereby to essentially eliminate wear of said side flanks over extended periods of operation while retaining the essential integrity of said zones of different fluid pressure;

(d) radial sealing means;

(e) high-pressure fluid conduit means communicating with the zone of highest pressure and low-pressure fluid conduit means communicating with the zone of lowest pressure;

(f) coupling means to maintain said scroll members in fixed angular relationship.

8. A positive fluid displacement apparatus in accordance with claim 7 wherein said low-pressure fluid conduit means is connected to a source of low pressure fluid and said apparatus is a compressor.

9. A positive fluid displacement apparatus in accordance with claim 7 wherein said driving means comprise, in combination (a) a drive shaft terminating in a crank plate and rotatable on a machine axis;

(b) a stub shaft extending from said orbiting scroll member, having bearing mount and counterweight means rigidly affixed thereto and rotatable on an axis parallel with and spaced from said machine axis by a distance equivalent to the orbit radius of said orbiting scroll member; and (c) locking means to rigidly affix said bearing mount and counterweight means to said crank plate in a predetermined relation thereby to define said clearance.

10. A positive fluid displacement apparatus in accordance with claim 9 wherein said locking means is adjustable.

11. A positive fluid displacement apparatus in accordance with claim 10 wherein said locking means comprises a pivot pin hole and a plurality of spaced threaded openings in said crank plate; a pivot pin hole in alignment with said pivot pin hole in said crank plate and a plurality of slots in said bearing mount and counterweight means in alignment with said threaded openings in said crank plate, a pivot pin seated in said pivot holes and threaded locking screws extending through said slots in said bearing mount and counterweight means and engaging said threaded openings in said crank plate, whereby said bearing mount and counterweight means may be moved through a small arc relative to said crank plate to adjust said clearance prior to rigidly locking said stub shaft to said drive shaft.

12. A positive fluid displacement apparatus in accordance with claim 9 wherein the end of each of said involute wraps facing said end plates is grooved to define a channel and (a) said radial sealing means comprise in combination compliance/sealing means located within said channel, each compliance/sealing means comprising in combination (a) a seal element of the same involute configuration as its associated wrap through which axial contact is effected between said wraps and said end plates, and (2) force applying means for actuating said seal element to effect radial sealing of said moving pockets; and (b) axial force applying means to urge said end plates and said wraps into sealing engagement through said compliance sealing/means.

13. A positive fluid displacement apparatus in accordance with claim 12 wherein said force applying means for actuating said seal element comprises an involutely configured elastomeric member in said channel in axial force applying relationship with said seal element.

14. A positive fluid displacement apparatus in accordance with claim 12 wherein said axial force applying means comprises thrust bearing means acting between said bearing mount and counterweight means and said end plate of said orbiting scroll member.

15. A positive fluid displacement apparatus in accordance with claim 7 including housing means defining an enclosure in which are located said scroll members, driving means, radial sealing means and coupling means.

16. A positive fluid displacement apparatus in accordance with claim 15 including fluid duct means defining around said housing a fluid passage, and means for circulating a cooling fluid through said fluid passage.

17. A positive fluid displacement apparatus in accordance with claim 15 including means to circulate lubricating oil within said housing means.

18. A positive fluid displacement apparatus in accordance with claim 17 including oil seal ring means arranged to seal off said fluid pockets whereby no appreciable amount of said lubricating oil enters said fluid pockets.

19. A positive fluid displacement apparatus in accordance with claim 18 wherein said means for circulating said fluid through said fluid passage comprises fan means driven by said driving means.

* * * * *

Disclaimer 4,082,484.—*John E. McCullough*, Carlisle, Mass. SCROLL-TYPE APPARATUS WITH FIXED THROW CRANK DRIVE MECHANISM. Patent dated Apr. 4, 1978. Disclaimer filed Apr. 6, 1979, by the assignee, *Arthur D. Little, Inc.*

Hereby enters this disclaimer to claims 1 and 2 of said patent.

[*Official Gazette June 19, 1979.*]

REEXAMINATION CERTIFICATE (97th)

United States Patent [19]

McCullough

[11] B1 4,082,484

[45] Certificate Issued Jun. 21, 1983

[54] SCROLL-TYPE APPARATUS WITH FIXED THROW CRANK DRIVE MECHANISM

[75] Inventor: John E. McCullough, Carlisle, Mass.

[73] Assignee: Arthur D. Little, Inc., Cambridge, Mass.

Reexamination Request

No. 90/000,194, Apr. 30, 1982

Reexamination Certificate for:

Patent No.: 4,082,484
Issued: Apr. 4, 1978
Appl. No.: 761,889
Filed: Jan. 24, 1977

Disclaimer of claims 1-2, filed Apr. 6, 1979 (9830.6.18).

[51] Int. Cl.[3] ..... F04C 17/02; F04C 29/10

[52] U.S. Cl. ..... 418/55; 418/57; 418/109

[58] Field of Search ..... 418/55, 57, 59

[56] References Cited

U.S. PATENT DOCUMENTS

| | | | |
|---|---|---|---|
| 801,182 | 10/1905 | Creux | 418/6 |
| 940,817 | 11/1909 | McLean, et al. | 418/6 |
| 1,223,997 | 4/1917 | DeCourcy May | 418/6 |
| 2,822,124 | 2/1958 | Klessig, et al. | 418/108 |
| 3,407,996 | 6/1966 | Olofsson, et al. | 418/9 |
| 3,473,728 | 10/1969 | Vulliez | 418/59 |
| 3,600,114 | 8/1971 | Dvorak, et al. | 418/55 |
| 3,802,809 | 4/1974 | Vulliez | 418/5 |
| 3,874,827 | 4/1975 | Young | 418/55 |
| 3,994,633 | 6/1982 | Shaffer | 418/55 X |

FOREIGN PATENT DOCUMENTS

| | | |
|---|---|---|
| 825643 | 3/1938 | France. |

*Primary Examiner*—Leonard E. Smith

[57] ABSTRACT

A positive fluid displacement scroll apparatus (compressor or expander) wherein the scroll members run with a small clearance between the wrap side flanks, thus essentially eliminating wearing of the wraps. When efficient radial sealing is attained, very little overall efficiency is sacrificed for the ability to construct low-cost scroll apparatus for a number of uses.

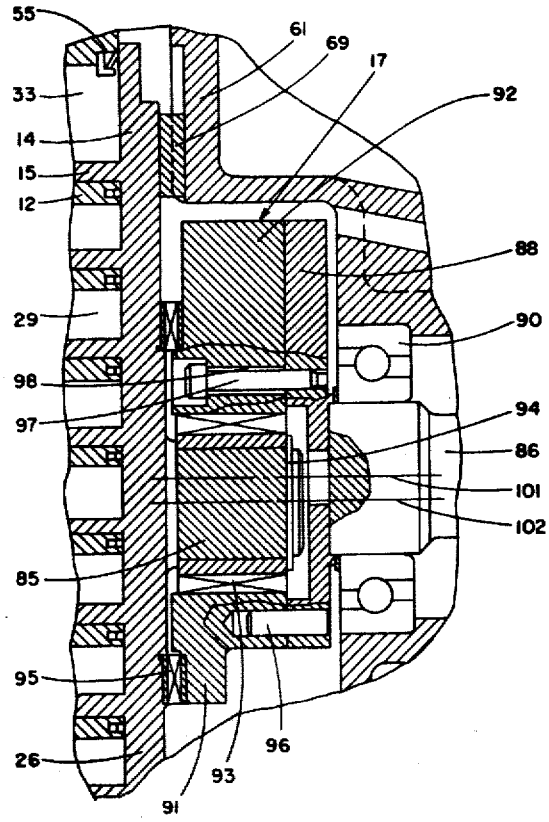

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 were previously disclaimed.

Claims 3, 5, and 7–11, having been finally determined to be unpatentable, are cancelled.

Claims 4, 6, 12, and 15 are determined to be patentable as amended:

4. A positive fluid displacement apparatus in accordance with claim [1] *20* wherein said driving means [comprise, in combination (a) a drive shaft terminating in a crank plate and rotatable on a machine axis; (b)] *further includes* a stub shaft extending from said orbiting scroll member[, having] *and one of said crank plate pieces comprises a* bearing mount and counterweight means rigidly affixed [thereto] *to said sub shaft* [and rotatable on an axis parallel with and spaced from said machine axis by a distance equivalent to the orbit radius of said orbiting scholl member; and (c) locking means to rigidly affix said bearing mount and counterweight means to said crank plate in a predetermined relation thereby to define said clearance].

6. A positive fluid displacement apparatus in accordance with claim [5] *4* wherein said [locking] *pivot and fastener* means [comprises] *comprise* a pivot pin hole and a plurality of spaced threaded openings in *one piece of* said crank plate *assembly,* a pivot pin hole in alignment with said pivot pin hole in said *one piece of said* crank plate *assembly* and a plurality of slots in [said bearing mount and counterweight means] *the other piece of said crank plate assembly* in alignment with said threaded openings in said *one piece of said* crank plate *assembly,* a pivot pin seated in said pivot holes and threaded locking screws extending through said slots [in said bearing mount and counterweight means] and engaging *said* threaded openings [in said crank plate], whereby said [bearing mount and counterweight means] *crank plate pieces* may be moved through a small arc relative to [said crank plate] *each other* to adjust said clearance prior to rigidly locking said stub shaft to said drive shaft.

12. A positive fluid displacement apparatus in accordance with claim [9] *6* wherein the end of each of said involute wraps facing said end plates is grooved to define a channel and (a) said radial sealing means comprise in combination compliance/sealing means located within said channel, each compliance/sealing means comprising in combination [(a)] *(1)* a seal element of the same involute configuration as its associated wrap through which axial contact is effected between said wraps and said end plates, and (2) force applying means for actuating said seal element to effect radial sealing of said moving pockets; and (b) axial force applying means to urge said end plates and said wraps into sealing engagement through said compliance sealing means.

15. A positive fluid displacement apparatus in accordance with claim [7] *6* including housing means defining an enclosure in which are located said scroll members, driving means, radial sealing means and coupling means.

Claims 13, 14, and 16–19, dependent on amended claims, are determined claims, are determined to be patentable.

New claim 20 is added and determined to be patentable.

*20. In a positive fluid displacement apparatus into which fluid is introduced through an inlet port for circulation through said apparatus and subsequently withdrawn through a discharge port, and comprising a stationary scroll member having an end plate and an involute wrap and an orbiting scroll member having an end plate and an involute wrap, driving means for orbiting said orbiting scroll member with respect to said stationary scroll member whereby the side flanks along with said end plates of said involute wraps define at least one moving pocket of variable volume and zones of different fluid pressure, coupling means to maintain said scroll members in fixed angular relationship, the improvement comprising said driving means being arranged to effect the orbiting of said orbiting scroll member such that a small clearance is maintained between said side flanks of said wraps thereby to essentially eliminate wear of said side flanks over extended periods of operation while retaining the essential integrity of said zones of different fluid pressure, said driving means comprising a drive shaft rotatable on a machine axis and connected to the orbiting scroll member through an adjustable fixed-throw crank drive mechanism having means to selectively permit relative angular adjustment between the positions of the crank drive mechanism and the orbiting scroll member, said angular adjustment effecting variation of said clearance, said crank drive mechanism comprising a crank plate assembly affixed to the drive shaft, the crank plate assembly including at least two pieces; a pivot means disposed at an offset location from the machine axis connecting the two pieces together so that the two pieces may be angularly rotated relative to each other about a pivot axis offset from but parallel to said machine axis for effecting said relative angular adjustment; and fastener means for releasably securing said two pieces in fixed angular relationship.*

* * * * *